US010453391B2

(12) United States Patent
Chen et al.

(10) Patent No.: US 10,453,391 B2
(45) Date of Patent: Oct. 22, 2019

(54) DISPLAY PANEL, PIXEL DRIVING CIRCUIT, AND DRVING METHOD THEREOF

(71) Applicant: Shenzhen China Star Optoelectronics Semiconductor Display Technology Co., Ltd., Shenzhen, Guangdong (CN)

(72) Inventors: Xiaolong Chen, Guangdong (CN); Yi-Chien Wen, Guangdong (CN); Ming-Jong Jou, Guangdong (CN)

(73) Assignee: Shenzhen China Star Optoelectronics Semiconductor Display Technology Co., Ltd, Shenzhen (CN)

( * ) Notice: Subject to any disclaimer, the term of this patent is extended or adjusted under 35 U.S.C. 154(b) by 104 days.

(21) Appl. No.: 15/744,080

(22) PCT Filed: Nov. 30, 2017

(86) PCT No.: PCT/CN2017/113911
§ 371 (c)(1),
(2) Date: Jan. 12, 2018

(87) PCT Pub. No.: WO2018/196378
PCT Pub. Date: Nov. 1, 2018

(65) Prior Publication Data

US 2018/0374419 A1 Dec. 27, 2018

(30) Foreign Application Priority Data

Apr. 28, 2017 (CN) ..... 2017 1 0297657

(51) Int. Cl.
*G09G 3/3233* (2016.01)

(52) U.S. Cl.
CPC ... *G09G 3/3233* (2013.01); *G09G 2300/0814* (2013.01); *G09G 2300/0819* (2013.01);
(Continued)

(58) Field of Classification Search
CPC ..... G09G 3/3233; G09G 2300/0814; G09G 2300/0819; G09G 2320/045; G09G 2320/0233
See application file for complete search history.

(56) References Cited

U.S. PATENT DOCUMENTS

2011/0164071 A1* 7/2011 Chung ..... G09G 3/3208 345/690
2016/0148571 A1 5/2016 Cho et al.
(Continued)

FOREIGN PATENT DOCUMENTS

CN 102682706 A 9/2012
CN 203300187 U 11/2013
(Continued)

*Primary Examiner* — Alexander Eisen
*Assistant Examiner* — Kebede T Teshome
(74) *Attorney, Agent, or Firm* — Andrew C. Cheng

(57) ABSTRACT

The present application provides a pixel driving circuit, which comprises a driving transistor, a first switch, a second switch, a third switch, a fourth switch, a first capacitor, a second capacitor, an initial-voltage-signal terminal, a data-voltage-signal terminal, a reset-voltage-signal terminal, and a driving-voltage-signal terminal. The driving transistor comprises a gate terminal, a source terminal, and a drain terminal. The first capacitor is connected between the source terminal and the gate terminal, the second capacitor is connected between the source terminal and a charge-voltage terminal. The charge-voltage terminal is respectively connected with the reset-voltage-signal terminal and the data-voltage-signal terminal via the first switch and the second switch. The drain terminal is connected with the driving-voltage-signal terminal via the third switch. The gate terminal is connected with the initial-voltage-signal terminal via the fourth switch. The present application further provides a pixel driving method and a display panel.

12 Claims, 8 Drawing Sheets

(52) U.S. Cl.
CPC ..... *G09G 2320/0233* (2013.01); *G09G 2320/045* (2013.01)

(56) References Cited

U.S. PATENT DOCUMENTS

| | | | | |
|---|---|---|---|---|
| 2017/0200414 | A1* | 7/2017 | Li | G09G 3/3258 |
| 2018/0190197 | A1* | 7/2018 | Chang | G09G 3/3233 |

FOREIGN PATENT DOCUMENTS

| | | | |
|---|---|---|---|
| CN | 103985351 | A | 8/2014 |
| CN | 104167167 | A | 11/2014 |
| CN | 104183211 | A | 12/2014 |
| CN | 107025883 | A | 8/2017 |

* cited by examiner

DISPLAY PANEL, PIXEL DRIVING CIRCUIT, AND DRVING METHOD THEREOF

BACKGROUND OF THE APPLICATION

This application claims the priority of an application No. 201710297657.2 filed on Apr. 28, 2017, entitled "DISPLAY PANEL, PIXEL DRIVING CIRCUIT, AND DRIVING METHOD THEREOF", the contents of which are hereby incorporated by reference.

Field of Application

The present application relates to a field of display technology, and more particularly to a pixel driving circuit, a driving method thereof, and a display panel comprises the pixel driving circuit.

Description of Prior Art

Due to the instability and technical limitations of the organic light-emitting diode (OLED) display panel manufacturing process, the threshold voltage of the driving transistor of each pixel unit in the OLED display panel may be different, which may result in inconsistence in the current in the LED of each pixel unit, thereby causing the uneven brightness of the OLED display panel.

In addition, as the driving time of the driving transistor goes by, the material of the driving transistor will be aged or mutated, causing the threshold voltage of the driving transistor to drift. Moreover, the degrees of aging of the material of the driving transistors are different, resulting in different threshold voltage drifts of the driving transistors in the OLED display panel, which may also cause the display unevenness of the OLED display panel, and the display unevenness may become more serious with the driving time and the aging of the drive transistor material.

SUMMARY OF THE APPLICATION

In view of the above problems, an object of the present application is to provide a pixel driving circuit, a driving method thereof and a display panel comprising the pixel driving circuit so as to improve brightness uniformity of the display panel.

In order to solve the problems in the prior art, the present application provides a pixel driving circuit, which comprises a driving transistor, a first switch, a second switch, a third switch, a fourth switch, a first capacitor, a second capacitor, a charge-voltage terminal, an initial-voltage-signal terminal, a data-voltage-signal terminal, a reset-voltage-signal terminal, and a driving-voltage-signal terminal. The driving transistor comprises with a gate terminal, a source terminal, and a drain terminal.

The first capacitor is connected between the source terminal and the gate terminal, the second capacitor is connected between the source terminal and the charge-voltage terminal. The charge-voltage terminal is respectively connected with the reset-voltage-signal terminal and the data-voltage-signal terminal via the first switch and the second switch. The drain terminal is connected with the driving-voltage-signal terminal via the third switch. The gate terminal is connected with the initial-voltage-signal terminal via the fourth switch.

Wherein the pixel driving circuit further comprises a first control-signal terminal. The first control-signal terminal is connected with a control terminal of the first switch and a control terminal of the second switch, so as to control on/off of the first switch and the second switch.

Wherein the pixel driving circuit further comprises a second control-signal terminal. The second control-signal terminal is connected with a control terminal of the third switch, so as to control on/off of the third switch.

Wherein the pixel driving circuit further comprises a third control-signal terminal. The third control-signal terminal is connected with a control terminal of the fourth switch, so as to control on/off of the fourth switch.

Wherein the pixel driving circuit further comprises a fifth switch, a fourth control-signal terminal, a light-emitting diode and a negative voltage-signal terminal. The fourth control-signal terminal is connected with a control terminal of the fifth switch to control on/off of the fifth switch. The light-emitting diode comprises a positive terminal and a negative terminal. The fifth switch is connected between the source terminal and the positive terminal to control on/off of the driving transistor and the light-emitting diode. The negative terminal is connected with the negative voltage-signal terminal.

The embodiment of the present application provides a display panel, which comprises the pixel driving circuit in any of the above embodiments.

The embodiment of the present application provides a pixel driving method, which comprises:

A pixel driving circuit is provided. The pixel driving circuit comprises a driving transistor, a light-emitting diode, a first capacitor, a second capacitor, a charge-voltage terminal, a data-voltage-signal terminal, and a reset-voltage-signal terminal. The driving transistor comprises with a gate terminal, a source terminal, and a drain terminal. The first capacitor is connected between the source terminal and the gate terminal, the second capacitor is connected between the source terminal and the charge-voltage terminal. The charge-voltage terminal is connected with the reset-voltage-signal terminal and the data-voltage-signal terminal. The source terminal is connected with the light-emitting diode.

A reset-storage phase, a data voltage is loaded at the charge-voltage terminal, an initial voltage is loaded at the gate terminal, and a driving voltage is loaded at the drain terminal to charge the source terminal until a potential difference between the source terminal and the gate terminal is Vth, the Vth is a threshold voltage of the driving transistor. The Vth is stored in the first capacitor.

A charge-sharing phase, a reset voltage is loaded at the charge-voltage terminal to change a potential of the gate terminal and a potential of the source terminal, so as to stabilize a driving current of the driving transistor.

A lighting phase, the reset voltage is loaded at the charge-voltage terminal and the driving voltage is loaded at the drain terminal to turn on the driving transistor and the light-emitting diode.

Wherein the pixel driving circuit further comprises a first switch, a second switch, a third switch, a fourth switch, a fifth switch, an initial-voltage-signal terminal, a driving-voltage-signal terminal, a first control-signal terminal, a second control-signal terminal, a third control-signal terminal, and a fourth control signal terminal. The charge-voltage terminal is respectively connected with the reset-voltage-signal terminal and the data-voltage-signal terminal via the first switch and the second switch; the drain terminal is connected with the driving-voltage-signal terminal via the third switch. The gate terminal is connected with the initial-voltage-signal terminal via the fourth switch. The fifth switch is connected between the source terminal and the light-emitting diode. The first control-signal terminal is connected with a control terminal of the first switch and a control terminal of the second switch, the second control-signal terminal is connected with the control terminal of the third switch, and the third control-signal terminal is connected with a control terminal of the fourth switch, and the fourth control-signal terminal is connected with the control terminal of the fifth switch.

In the reset-storage phase, the first control-signal terminal and the fourth control-signal terminal are loaded with a low-level signal, and the second control-signal terminal and the third control-signal terminal are loaded with a high-level signal, so that the second switch, the third switch, and the fourth switch are turned on, and the first switch and the fifth switch are turned off, the charge-voltage terminal is loaded with the data voltage via the second switch, the data voltage is Vdata, the gate terminal is loaded with the initial voltage via the fourth switch, the initial voltage is Vini, and the driving voltage charges the source terminal via the third switch and the driving transistor until a potential of the source terminal is Vini-Vth.

Wherein in the charge-sharing phase, the first control-signal terminal are loaded a high-level signal, the second control-signal terminal, the third control-signal terminal, and the fourth control-signal terminal are loaded with a low-level signal, so that the first switch is turned on, the second switch, the third switch, the fourth switch, and the fifth switch are turned off, and the charge-voltage terminal is loaded with the reset voltage via the first switch, the reset voltage is Vref, and the potential of the gate terminal is Vini+(Vref−Vdata). The potential of the source terminal is Vini-Vth+δV, and the potential difference between the gate terminal and the source terminal is Vref−Vdata+Vth−δV, δV=(Vref−Vdata)*C2/(C1+C2), C1 is a capacitance value of the first capacitor, C2 is the capacitance of the first capacitor, so that a driving current is independent of the threshold voltage.

Wherein the pixel driving circuit further comprises a negative voltage-signal terminal. The light-emitting diode comprises a positive terminal and a negative terminal. The fifth switch is connected between the source terminal and the positive terminal, and the negative terminal is connected with the negative voltage-signal terminal.

In the lighting phase, the first control signal terminal, the second control signal terminal, and the fourth control signal terminal are loaded with a high-level signal, the third control-signal terminal is loaded with a low-level signal, so that the first switch, the third switch and the fifth switch are turned on, and the second switch and the fourth switch are turned off, the charge-voltage terminal is loaded with the reset voltage via the first switch, so that the potential of the source terminal is unchanged, and the third switch, the driving transistor, and the fifth switch are turned on, so that the driving-voltage-signal terminal are conducted with the negative voltage-signal terminal, for driving the light-emitting diode light by the driving current.

The pixel driving circuit provided in the present application comprises a driving transistor, which comprises a gate terminal, a source terminal and a drain terminal. The first capacitor is disposed between the source terminal and the gate terminal, and the second capacitor is connected between the source terminal and the charge-voltage terminal, and the charge-voltage terminal is respectively connected with the reset-voltage-signal terminal and the data-voltage-signal terminal via the first switch and the second switch; the drain terminal is connected with the initial-voltage-signal terminal via the fourth switch. The source terminal is charged by the driving-voltage-signal terminal until the potential difference between the gate terminal and the source terminal is equal to the threshold voltage Vth of the driving transistor, and then charging the charge-voltage terminal by the reset-voltage-signal terminal, so that the potential difference between the gate terminal and the source terminal is Vref−Vdata+Vth−δV, such that the driving current $I=k(Vref-Vdata-\delta V)^2$, where δV is independent of Vth, so that the driving current is independent of the threshold voltage Vth, so that the current of the light-emitting diode is stable to ensure that the evenly lighting brightness of the light-emitting diode.

The pixel driving method provided by the present application, the source terminal is charged by the driving-voltage-signal terminal until the potential difference between the source terminal and the gate terminal is the threshold voltage Vth of the driving transistor, and then charging the charge-voltage terminal by the reset-voltage-signal terminal, so that the potential difference between the gate terminal and the source terminal is Vref−Vdata+Vth−δV, such that the driving current $I=k(Vref-Vdata-\delta V)^2$, where δV is independent of Vth so that the driving current is independent of the threshold voltage Vth, so that the current of the light-emitting diode is stable to ensure that the evenly lighting brightness of the light-emitting diode.

The display panel provided by the present application comprises the pixel driving circuit described above, so that the driving current generated by the driving transistor is independent of the threshold voltage of the driving transistor, so as to stabilize the driving current generated by the driving transistor and eliminate the driving current issues caused by the aging of the driving transistor or the limitation of the manufacturing process, the problem of threshold voltage drift is solved, so that the current flowing through the light-emitting diode is stabilized, the light emitting brightness of the light-emitting diode is uniform, and the display effect of the screen is improved.

BRIEF DESCRIPTION OF THE DRAWINGS

In order to describe the technical solutions in the embodiments of the present application or in the conventional art more clearly, the accompanying drawings required for describing the embodiments or the conventional art are briefly introduced. Apparently, the accompanying drawings in the following description only show some embodiments of the present application. For those skilled in the art, other drawings may be obtained based on these drawings without any creative work.

DETAILED DESCRIPTION OF THE PREFERRED EMBODIMENTS

The technical solutions in the embodiments of the present application are clearly and completely described below with reference to the accompanying drawings in the embodiments of the present application.

Figure 1:
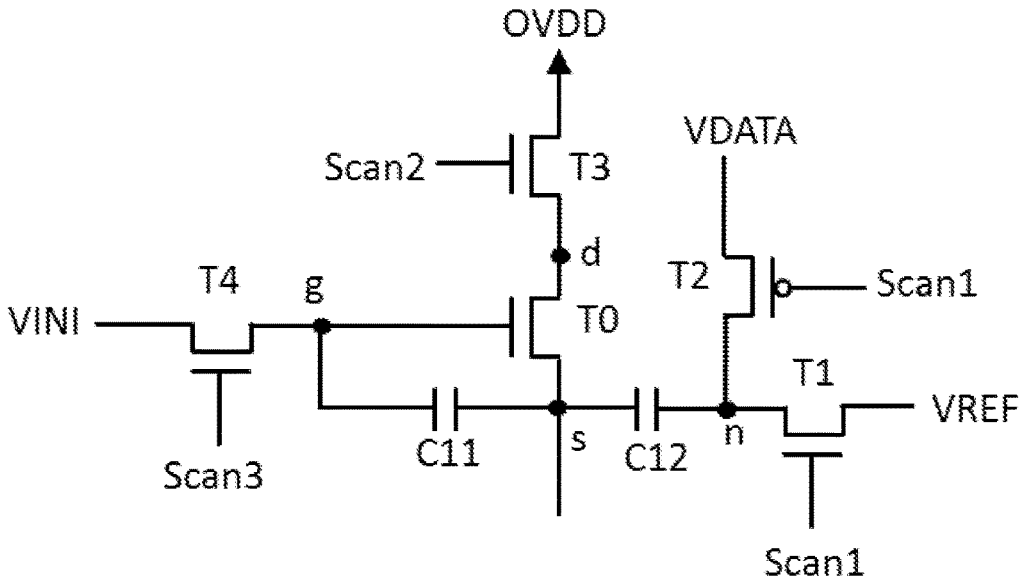
FIG. 1 is a structural illustrative diagram of a pixel driving circuit of a first embodiment according to the present application.

Please refer to FIG. 1, which a pixel driving circuit is provided in the first embodiment of the present application. The pixel driving circuit comprises a driving transistor T0, a first switch T1, a second switch T2, a third switch T3, a fourth switch T4, a first capacitor C11, a second capacitor C12, a charge-voltage terminal n, an initial-voltage-signal terminal VINI, a data-voltage-signal terminal VDATA, a reset-voltage-signal terminal VREF, and a driving-voltage-signal terminal OVDD. The driving transistor T0 comprises a gate terminal g, a source terminal s and a drain terminal d.

The first capacitor C11 is connected between the source terminal s and the gate terminal g to store a potential difference between the gate terminal g and the source terminal s. The second capacitor C12 is connected between the source terminal s and the charge-voltage terminal n. The charge-voltage terminal n is respectively connected with the reset-voltage-signal terminal VREF and the data-voltage-signal terminal VDATA via the first switch T1 and the second switch T2, for loading a reset voltage Vref or a data voltage Vdata at the charge-voltage terminal n. The drain terminal d is connected with the driving-voltage-signal terminal OVDD via the third switch T3, for loading a driving voltage Vdd at the drain terminal d. The gate terminal g is connected with the initial-voltage-signal terminal VINI via the fourth switch T4, for loading an initial voltage Vini at the gate terminal g. The switch described in this embodiment includes but is not limited to a module having a control circuit with on/off function such as a switch circuit, a thin film transistor and the like.

With a driving method, the pixel driving circuit provided in this embodiment controls the second switch T2, the third switch T3, and the fourth switch T4 to be turned on, and the first switch T1 be turned off, during the reset-storage phase, so that the gate terminal g is loaded with the initial voltage Vini, the drain terminal d is loaded with the driving voltage Vdd, the driving voltage Vdd charges the source terminal s via the third switch T3 and the driving transistor T0, until the potential difference between the gate terminal g and the source terminal s is the threshold voltage Vth of the driving transistor T0; during the charge-sharing phase, the first switch T1 is turned on, and the second switch T2, The third switch T3 and the fourth switch T4 are turned off, so that the reset voltage Vref is charged to the charge-voltage terminal n is loaded with the reset voltage Vref, so that the potential of the gate terminal g and the potential of the source terminal s are changed, and further, a driving current I generated by the transistor T0 is independent of the threshold voltage Vth of the driving transistor T0, so that the driving current I generated by the driving transistor T0 is stabilized.

In one embodiment, the pixel driving circuit further comprises a first control-signal terminal Scan1. The first control-signal terminal Scan1 is connected with a control terminal of the first switch T1 and a control terminal of the second switch T2, so as to control on/off of the first switch T1 and the second switch T2.

In one embodiment, the pixel driving circuit further comprises a second control-signal terminal Scan2. The second control-signal terminal Scan2 is connected with a control terminal of the third switch T3, so as to control on/off of the third switch T3.

In one embodiment, the pixel driving circuit further comprises a third control-signal terminal Scan3. The third control-signal terminal Scan3 is connected with a control terminal of the fourth switch T4, so as to control on/off of the fourth switch T4.

Figure 2:
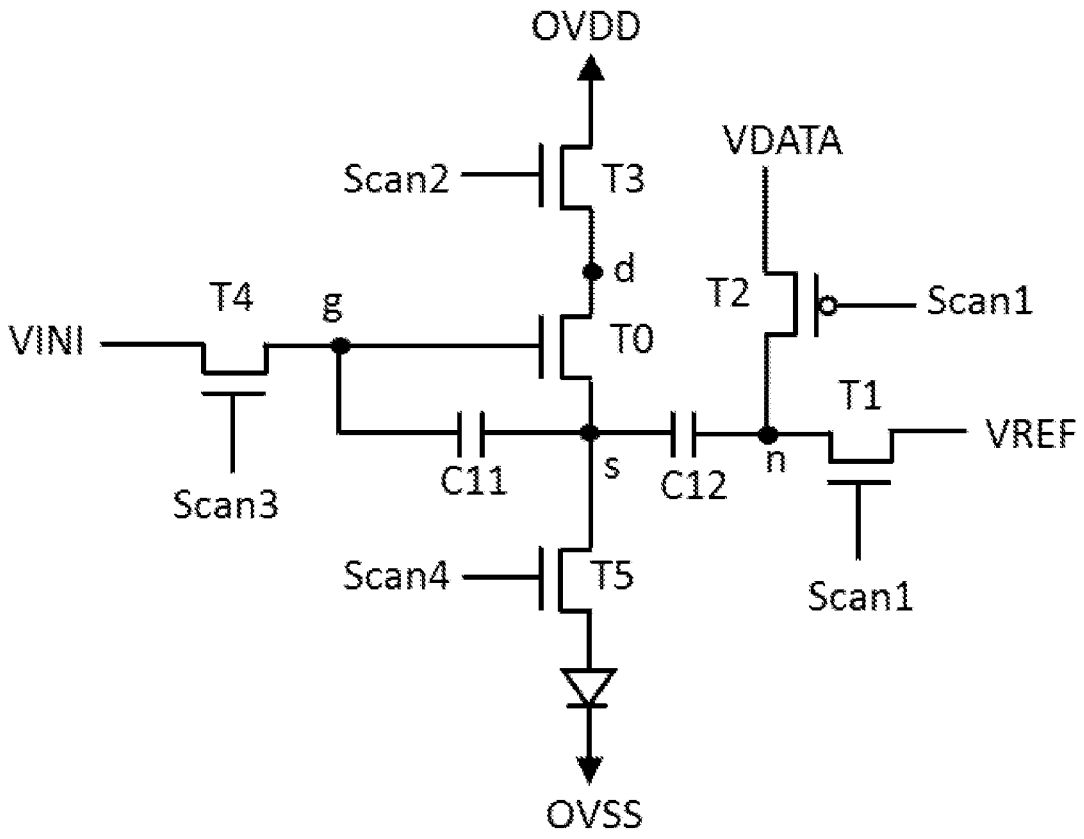
FIG. 2 is a structural illustrative diagram of a pixel driving circuit of a second embodiment according to the present application.

Please refer to FIG. 2, which is a pixel driving circuit of a second embodiment according to the present application, which comprises the pixel driving circuit provided by the first embodiment, making the driving current I generated by the driving transistor T0 stable. The embodiment further comprises a light-emitting diode L, a fifth switch T5, and a negative voltage-signal terminal OVSS. The light-emitting diode L may be an organic light-emitting diode or the like. The light-emitting diode L has a positive terminal and a negative terminal, and the fifth switch T5 is connected between the source terminal s and the positive terminal to control on/off of the driving transistor T0 and the light-emitting diode L. The negative terminal is connected with the negative voltage-signal terminal OVSS. When the third switch T3, the driving transistor T0, and the fifth switch T5 are turned on, the driving-voltage-signal terminal OVDD and the negative voltage-signal terminal OVSS are conducted, and the driving current I generated by the driving transistor T0 drives the light-emitting diode L to light. In this embodiment, the driving current I is independent of the threshold voltage Vth of the driving transistor T0, which eliminates the problem of threshold voltage Vth shift caused by the aging of the driving transistor T0 or the manufacturing process of the pixel unit, so that the current flowing through the light-emitting diode L, the luminance of the light-emitting diode L is ensured to be uniform, and the display effect of the picture is improved.

In one embodiment, the pixel driving circuit further comprises a fourth control-signal terminal Scan4. The fourth control-signal terminal Scan4 is connected with a control terminal of the fifth switch T5, so as to control on/off of the fifth switch T5.

In one embodiment, the first switch T1, the driving transistor T0, the third switch T3, the fourth switch T4, and the fifth switch T5 are all N-type thin film transistors. When the control terminal of the switch is applied with a high-level voltage, the switch is in the on state, and the switch is in the off state when a low-level voltage is applied to the control terminal of the switch. The second switch T2 is a P-type thin film transistor. When a low-level voltage is applied to the control terminal of the switch, the second switch T2 is in the on state, and the control terminal of the switch applied with a high-level voltage, the second switch T2 is in the off state. In other embodiments, the first switch T1, the driving transistor T0, the second switch T2, the third switch T3, the fourth switch T4, and the fifth switch T5 may be other combination of P-type or/and N-type thin film transistor, the present application do not limit this.

In the embodiment of the present application, when the pixel driving circuit is applied to a display panel or a display device, the control-signal terminal may be connected with the scanning signal line in the display panel or the display device.

Figure 3:
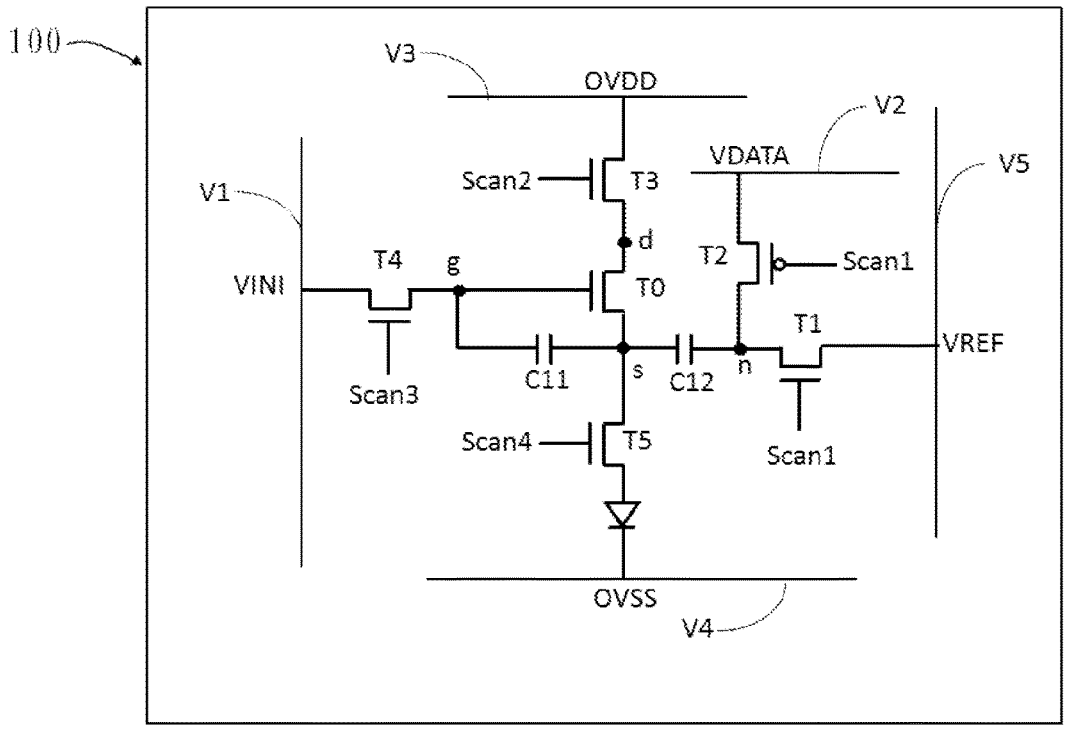
FIG. 3 is a structural illustrative diagram of a display panel of an embodiment according to the present application.

Please refer to FIG. 3, the embodiment of the present application further provides a display panel 100 comprising the pixel driving circuit provided in any one of the above embodiments and further comprises an initial-voltage-signal line V1, a data-voltage-signal line V2, a driving-voltage-signal line V3, a negative voltage-signal line V4, and a reset-voltage-signal line V5. The initial-voltage-signal terminal VINI is connected with the initial-voltage-signal line V1 to load the initial voltage Vini. The data-voltage-signal terminal VDATA is connected with the data-voltage-signal line V2 to load the data voltage Vdata. The driving-voltage-signal terminal OVDD is connected with the driving-voltage-signal line V3 for loading the driving voltage Vdd. The negative voltage-signal terminal OVSS is connected with the negative voltage-signal line V4 to load the negative voltage Vss. The reset-voltage-signal terminal VREF is connected with the reset-voltage-signal line V5 to load the reset voltage Vref. Specifically, the display panel may comprise a plurality of pixel arrays, and each pixel corresponds to any one of the pixel driving circuits in the above example embodiment. Since the pixel driving circuit eliminates the influence of the threshold voltage on the driving current I, the display of the light-emitting diode L is stable and the display brightness uniformity of the display panel is improved. Therefore, the display quality can be greatly improved.

Figure 4:
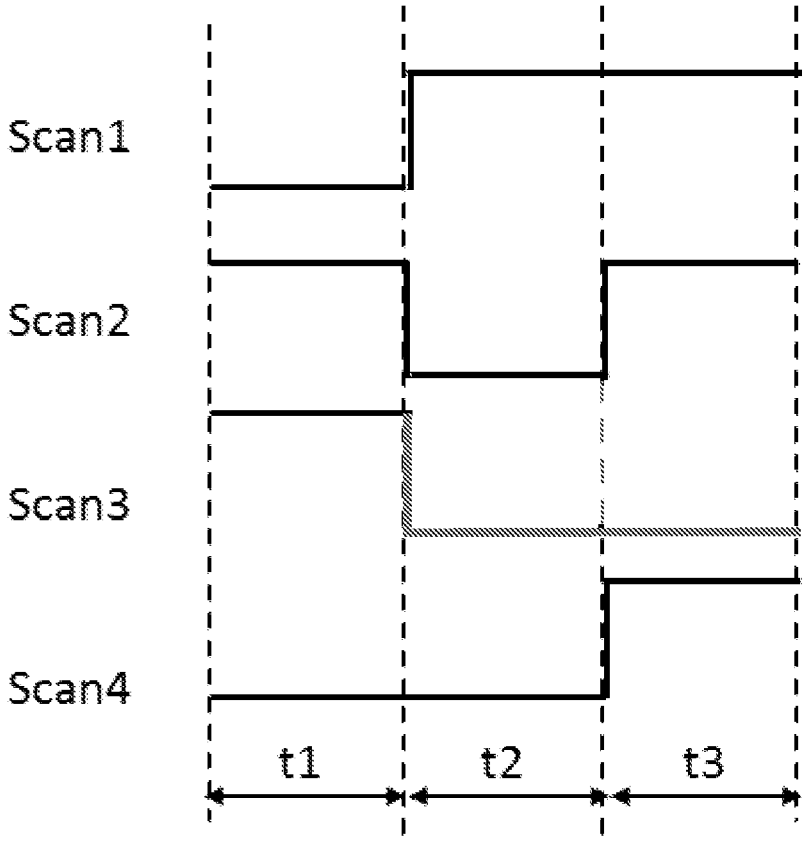
FIG. 4 is a time-domain diagram of a pixel driving circuit of an embodiment according to the present application.
Figure 5:
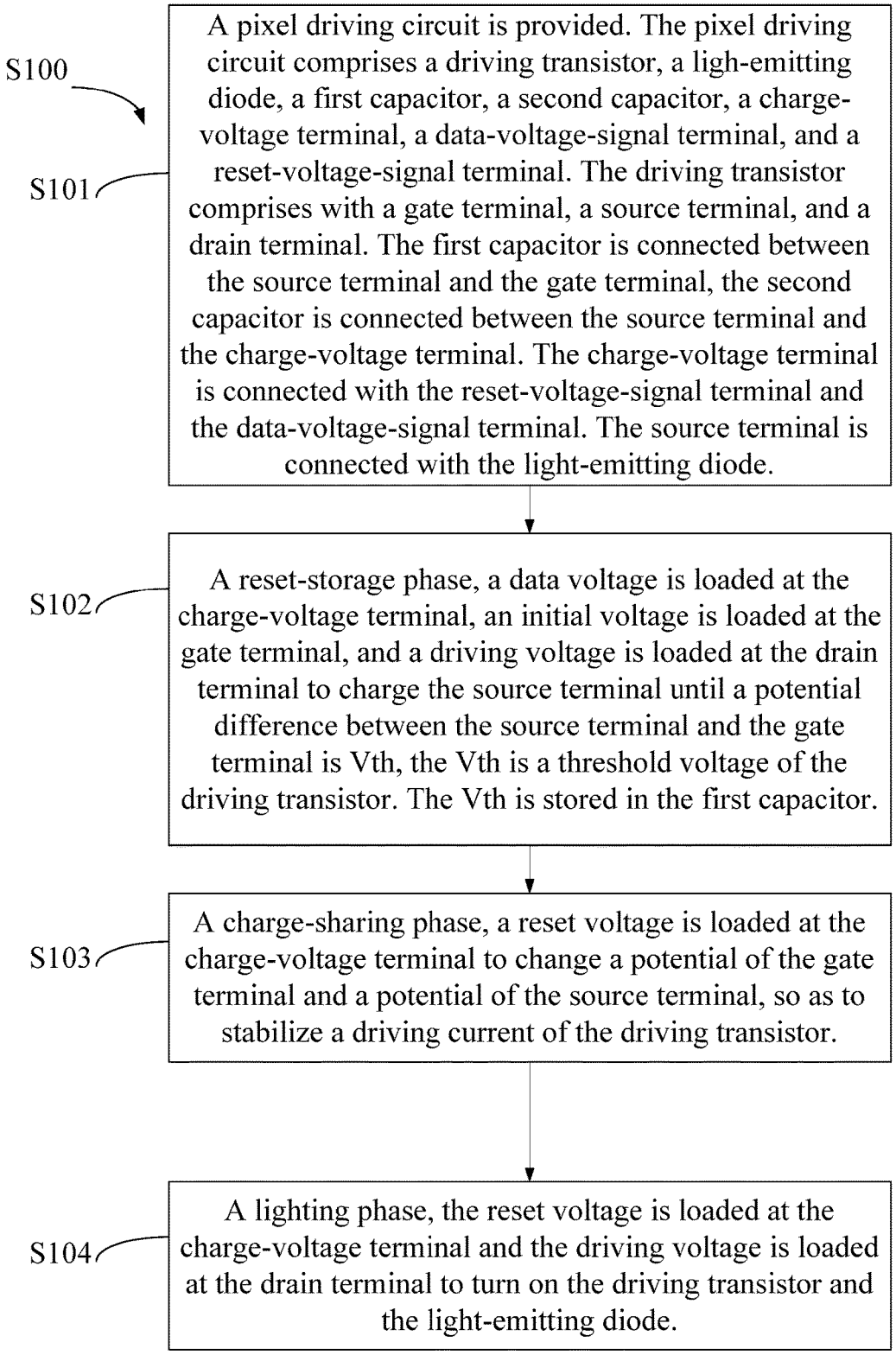
FIG. 5 is a flow diagram of a pixel driving method of one embodiment according to the present application.

Please further refer to FIGS. 4-8; FIG. 4 is a time-domain diagram of a pixel driving circuit of an embodiment according to the present application. FIG. 5 is a flow diagram of a pixel driving method S100 of one embodiment according to the present application, which is used for driving the pixel driving circuit of the above embodiment. The driving method comprises:

S101, refer to FIGS. 2-3, a pixel driving circuit is provided, which comprises a driving transistor T0, a light-emitting diode L, a first capacitor C11, a second capacitor C12, a charge-voltage terminal n, a data-voltage-signal terminal VDATA, and a reset-voltage-signal terminal VREF. The driving transistor T0 comprises a gate terminal g, a source terminal s, and a drain terminal d. The first capacitor C11 is connected between the source terminal s and the gate terminal g. The second capacitor C12 is connected between the source terminal s and the charging voltage terminal n. The charge-voltage terminal n is connected with the reset-voltage-signal terminal VREF and the data-voltage-signal terminal VDATA. The source terminal s is connected with the light-emitting diode L.

Further, the pixel driving circuit further comprises a first switch T1, a second switch T2, a third switch T3, a fourth switch T4, a fifth switch T5, an initial-voltage-signal terminal VINI, a driving-voltage-signal terminal OVDD, a first control-signal terminal Scan1, a second control-signal terminal Scan2, a third control-signal terminal Scan3, and a fourth control-signal terminal Scan4. The charge-voltage terminal n is respectively connected to the reset-voltage-signal terminal VREF and the data-voltage-signal terminal VDATA via the first switch T1 and the second switch T2. The drain terminal d is connected with the driving-voltage-signal terminal OVDD via the third switch T3, and the gate terminal g is connected with the initial-voltage-signal terminal VINI via the fourth switch T4. The fifth switch T5 is connected between the source terminal s and the light-emitting diode L. The first control-signal terminal Scan1 is connected with the control terminal of the first switch T1 and the control terminal of the second switch T2. The second control-signal terminal Scan2 is connected with the control terminal of the third switch T3. The third control-signal terminal Scan3 is connected with the control terminal of the fourth switch T4. The fourth control-signal terminal Scan4 is connected with the control terminal of the fifth switch T5.

Further, the pixel driving circuit further comprises a negative voltage-signal terminal OVSS, the light-emitting diode L comprises a positive terminal and a negative terminal. The fifth switch T5 is connected between the source terminal s and the positive terminal. The negative terminal is connected with the negative voltage-signal terminal OVSS.

The initial-voltage-signal terminal VINI is connected with the initial-voltage-signal line V1 for loading the initial voltage Vini. The data-voltage-signal terminal VDATA is connected with the data-voltage-signal line V2 for loading the data voltage Vdata. The driving-voltage-signal terminal OVDD is connected with the driving-voltage-signal line V3 for loading the driving voltage Vdd. The negative voltage-signal terminal OVSS is connected with the negative voltage-signal line V4 for loading the negative voltage Vss. The reset-voltage-signal terminal VREF is connected with the reset-voltage-signal line V5 for loading the reset voltage Vref.

Figure 6:
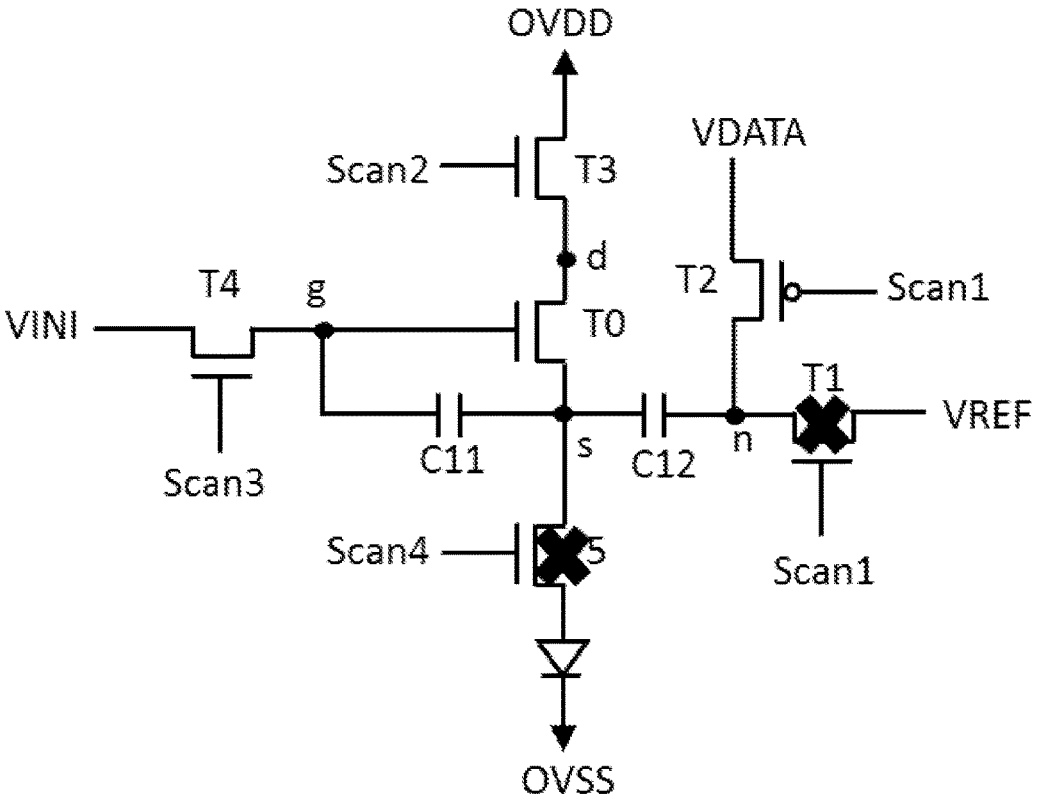
FIG. 6 is a state diagram of a reset phase of a pixel driving circuit according to an embodiment of the present application.

S102, referring to FIGS. 4-6, when entering the reset phase t1, a data voltage Vdata is loaded at the charge-voltage terminal n, an initial voltage Vini is loaded at the gate terminal g, and a driving voltage Vdd is loaded at the drain terminal d, so as to charge the source terminal s until the potential difference between the gate terminal g and the source terminal s is Vth, Vth is the threshold voltage of the driving transistor T0, and the Vth is stored in the first capacitor C11.

In one embodiment, the first control-signal terminal Scan1 and the fourth control-signal terminal Scan4 are loaded with a low-level signal, and the second control-signal terminal Scan2 and the third control-signal terminal Scan3 are loaded with a high-level signal, so as to turn on the second switch T2, the third switch T3 and the fourth switch T4, and turn off the first switch T1 and the fifth switch T5. The charge-voltage terminal n is loaded with the data voltage Vdata via the second switch T2. The gate terminal g is loaded with the initial voltage Vini via the fourth switch T4. The driving voltage Vdd charges the source terminal s via the third switch T3 and the driving transistor T0 until the potential of the source terminal s is Vini-Vth.

Figure 7:
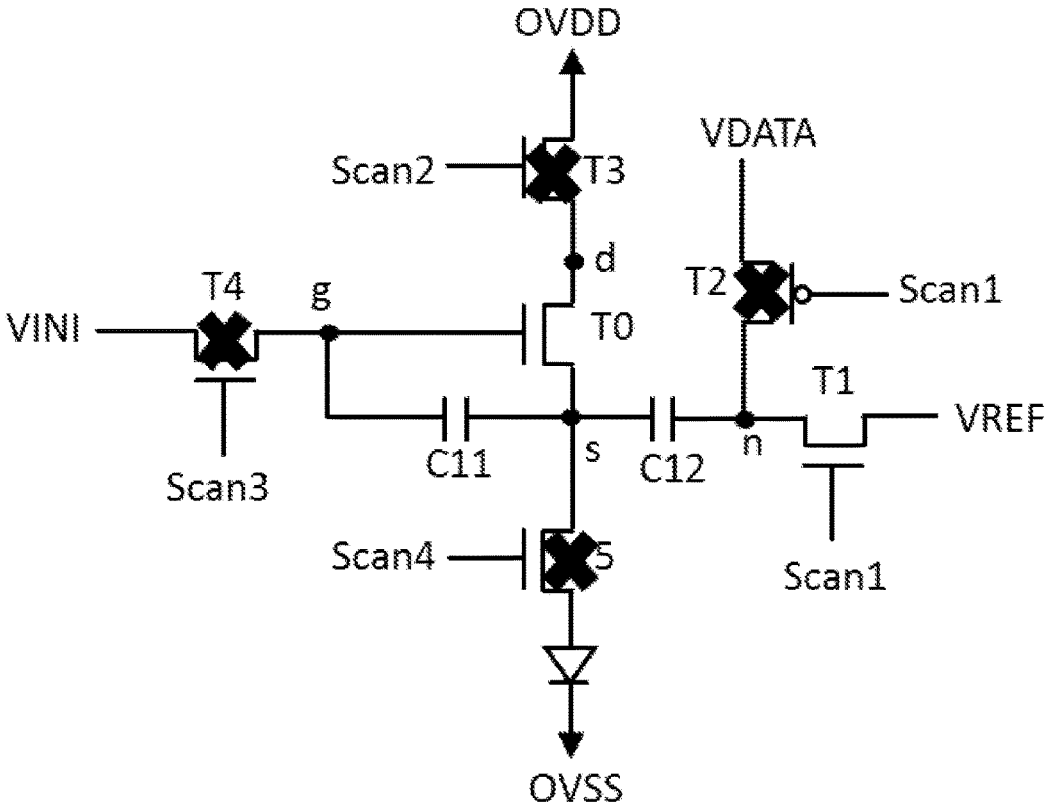
FIG. 7 is a state diagram of a storage phase of a pixel driving circuit according to an embodiment of the present application.

S103, referring to FIGS. 4, 5, and 7, when entering the charge-sharing phase t2, the charge-voltage terminal n is loaded with a reset voltage Vref, to change the potentials of the gate terminal g and the source terminal s, so as to stabilize the driving current of the driving transistor T0.

In one embodiment, the first control-signal terminal Scan1 and the third control-signal terminal Scan3 are loaded with a high-level signal, and the second control-signal terminal Scan2 and the fourth control-signal terminal Scan4 are loaded with a low-level signal, so as to turn on the first switch T1, and turn off the second switch T2, the third switch T3, the fourth switch T4 and the fifth switch T5. The charge-voltage terminal n is loaded with the reset voltage Vref via the first switch T1, to change the potentials of the gate terminal g and the source terminal s. According to the charge sharing principle, the potential at the gate terminal g is Vini+(Vref−Vdata), the potential at the source terminal s is Vini−Vth+δV, the potential difference Vgs between the potential at the gate terminal g and the potential at the source terminal s is Vref−Vdata+Vth−δV, and δV=(Vref−Vdata)*C2/(C1+C2), C1 is a capacitance of the first capacitor C11, and C2 is a capacitance of the second capacitor C12. According to a transistor I-V curve equation $I=k(Vgs-Vth)^2$, $I=k[Vref-Vdata)*C1/(C1+C2)]^2$, k is the intrinsic conduction factor of the driving transistor T0, which is determined by the characteristics of the driving transistor T0 itself. It can be seen that the driving current I is independent of the threshold voltage Vth of the driving transistor T0, thereby stabilizing the driving current I of the driving transistor T0.

Figure 8:
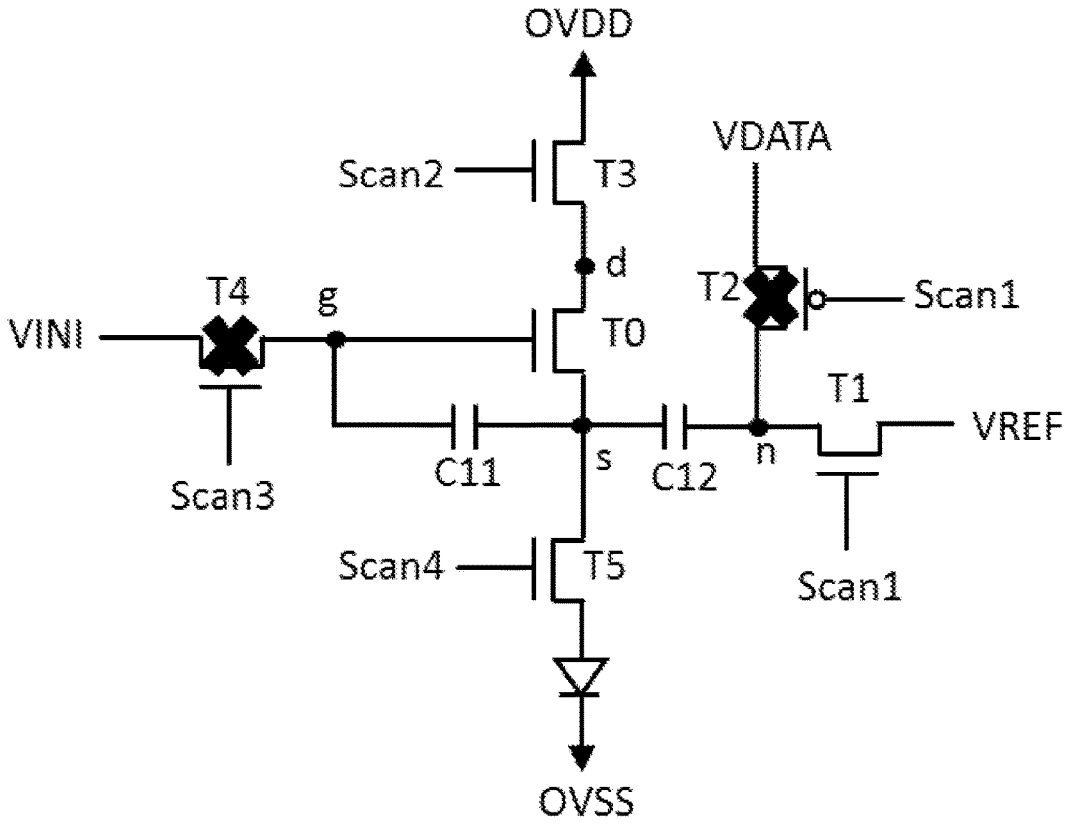
FIG. 8 is a state diagram of a lighting phase of a pixel driving circuit according to an embodiment of the present application.

S104, referring to FIGS. 4, 5, and 8, when entering the lighting phase t3, the charge-voltage terminal n is loaded with the reset voltage Vref, and the drain terminal d is loaded with the driving voltage Vdd, so as to turn on the driving transistor T0 and the light-emitting diode L.

In one embodiment, the first control-signal terminal Scan1, the second control-signal terminal Scan2, and the fourth control-signal terminal Scan4 are loaded with a high-level signal, and the third control-signal terminal Scan3 is loaded with a low-level signal, so as to turn on the first switch T1, the third switch T3, and the fifth switch T5, and turn off the second switch T2 and the fourth switch T4. The charge-voltage terminal n is loaded with the reset voltage Vref via the first switch T1, so as to keep the potential of the source terminal s unchanged and the driving current I is unchanged. The third switch T3, the driving transistor T0, and the fifth switch T5 are turned on, so that the driving voltage Vdd terminal is conducted with the negative voltage-signal terminal OVSS, to make the light-emitting diode L be driven by the driving current I. Therefore, the pixel driving circuit driven by the pixel driving method provided in this embodiment of the present application eliminates the influence of the threshold voltage Vth on the light-emitting diode L, improves the display uniformity of the panel, and improves the luminous efficiency.

The foregoing disclosure is merely one preferred embodiment of the present application, and certainly cannot be used to limit the scope of the present application. A person having ordinary skill in the art may understand that all or part of the processes in the foregoing embodiments may be implemented, and the present application may be implemented according to the present application, equivalent changes in the requirements are still covered by the application.

What is claimed is:

1. A pixel driving circuit, comprising a driving transistor, a first switch, a second switch, a third switch, a fourth switch, a first capacitor, a second capacitor, a charge-voltage terminal, an initial-voltage-signal terminal, a data-voltage-signal terminal, a reset-voltage-signal terminal, and a driving-voltage-signal terminal; wherein the driving transistor comprises a gate terminal, a source terminal, and a drain terminal;

the first capacitor is connected between the source terminal and the gate terminal, the second capacitor is connected between the source terminal and the charge-voltage terminal; the charge-voltage terminal is respectively connected with the reset-voltage-signal terminal and the data-voltage-signal terminal via the first switch and the second switch; the drain terminal is connected with the driving-voltage-signal terminal via the third switch; the gate terminal is connected with the initial-voltage-signal terminal via the fourth switch;

further comprising a first control-signal terminal, wherein the first control-signal terminal is connected with a control terminal of the first switch and a control terminal of the second switch, so as to control on/off of the first switch and the second switch.

2. The pixel driving circuit according to claim 1, further comprising a second control-signal terminal, wherein the second control-signal terminal is connected with a control terminal of the third switch, so as to control on/off of the third switch.

3. The pixel driving circuit according to claim 2, further comprising a third control-signal terminal, wherein the third control-signal terminal is connected with a control terminal of the fourth switch, so as to control on/off of the fourth switch.

4. The pixel driving circuit according to claim 3, further comprising a fifth switch, a fourth control-signal terminal, a light-emitting diode and a negative voltage-signal terminal; wherein the fourth control-signal terminal is connected with a control terminal of the fifth switch to control on/off of the fifth switch; the light-emitting diode comprises a positive terminal and a negative terminal, the fifth switch is connected between the source terminal and the positive terminal to control on/off of the driving transistor and the light-emitting diode, the negative terminal is connected with the negative voltage-signal terminal.

5. A display panel, comprising a pixel driving circuit, wherein the pixel driving circuit comprises a driving transistor, a first switch, a second switch, a third switch, a fourth switch, a first capacitor, a second capacitor, a charge-voltage terminal, an initial-voltage-signal terminal, a data-voltage-signal terminal, a reset-voltage-signal terminal, and a driving-voltage-signal terminal; the driving transistor comprises a gate terminal, a source terminal, and a drain terminal;

the first capacitor is connected between the source terminal and the gate terminal, the second capacitor is connected between the source terminal and the charge-voltage terminal; the charge-voltage terminal is respectively connected with the reset-voltage-signal terminal and the data-voltage-signal terminal via the first switch and the second switch; the drain terminal is connected with the driving-voltage-signal terminal via the third switch; the gate terminal is connected with the initial-voltage-signal terminal via the fourth switch;

further comprising a first control-signal terminal, wherein the first control-signal terminal is connected with a control terminal of the first switch and a control terminal of the second switch, so as to control on/off of the first switch and the second switch.

6. The display panel according to claim 5, further comprising a second control-signal terminal, wherein the second control-signal terminal is connected with a control terminal of the third switch, so as to control on/off of the third switch.

7. The display panel according to claim 6, further comprising a third control-signal terminal, wherein the third control-signal terminal is connected with a control terminal of the fourth switch, so as to control on/off of the fourth switch.

8. The display panel according to claim 7, further comprising a fifth switch, a fourth control-signal terminal, a light-emitting diode and a negative voltage-signal terminal; wherein the fourth control-signal terminal is connected with a control terminal of the fifth switch to control on/off of the fifth switch; the light-emitting diode comprises a positive terminal and a negative terminal, the fifth switch is connected between the source terminal and the positive terminal to control on/off of the driving transistor and the light-emitting diode, the negative terminal is connected with the negative voltage-signal terminal.

9. A pixel driving method, comprising:

providing a pixel driving circuit, which comprises a driving transistor, a light-emitting diode, a first capacitor, a second capacitor, a charge-voltage terminal, a data-voltage-signal terminal, and a reset-voltage-signal terminal; the driving transistor comprises a gate terminal, a source terminal, and a drain terminal; the first capacitor is connected between the source terminal and the gate terminal, the second capacitor is connected between the source terminal and the charge-voltage terminal; the charge-voltage terminal is connected with the reset-voltage-signal terminal and the data-voltage-signal terminal; the source terminal is connected with the light-emitting diode;

a reset-storage phase, loading a data voltage at the charge-voltage terminal, loading an initial voltage at the gate terminal, and loading a driving voltage at the drain terminal to charge the source terminal until a potential difference between the source terminal and the gate terminal is Vth, the Vth is a threshold voltage of the driving transistor, and the Vth is stored in the first capacitor;

a charge-sharing phase, loading a reset voltage at the charge-voltage terminal to change a potential of the gate terminal and a potential of the source terminal, so as to stabilize a driving current of the driving transistor;

a lighting phase, loading the reset voltage at the charge-voltage terminal and loading the driving voltage at the drain terminal to turn on the driving transistor and the light-emitting diode.

10. The pixel driving method according to claim 9, wherein the pixel driving circuit further comprises a first switch, a second switch, a third switch, a fourth switch, a fifth switch, an initial-voltage-signal terminal, a driving-voltage-signal terminal, a first control-signal terminal, a second control-signal terminal, a third control-signal terminal, and a fourth control signal terminal; the charge-voltage terminal is respectively connected with the reset-voltage-signal terminal and the data-voltage-signal terminal via the first switch and the second switch; the drain terminal is connected with the driving-voltage-signal terminal via the third switch, the gate terminal is connected with the initial-voltage-signal terminal via the fourth switch; the fifth switch is connected between the source terminal and the light-emitting diode; the first control-signal terminal is connected with a control terminal of the first switch and a control terminal of the second switch, the second control-signal terminal is connected with the control terminal of the third switch, and the third control-signal terminal is connected with a control terminal of the fourth switch, and the fourth control-signal terminal is connected with the control terminal of the fifth switch;

in the reset-storage phase, the first control-signal terminal and the fourth control-signal terminal are loaded with a low-level signal, and the second control-signal terminal and the third control-signal terminal are loaded with a high-level signal, so that the second switch, the third switch, and the fourth switch are turned on, and the first switch and the fifth switch are turned off, the charge-voltage terminal is loaded with the data voltage via the second switch, the data voltage is Vdata, the gate terminal is loaded with the initial voltage via the fourth switch, the initial voltage is Vini, and the driving voltage charges the source terminal via the third switch and the driving transistor until a potential of the source terminal is Vini-Vth.

11. The pixel driving method according to claim 10, wherein in the charge-sharing phase, the first control-signal terminal are loaded a high-level signal, the second control-signal terminal, the third control-signal terminal, and the fourth control-signal terminal are loaded with a low-level signal, so that the first switch is turned on, the second switch, the third switch, the fourth switch, and the fifth switch are turned off, and the charge-voltage terminal is loaded with the reset voltage via the first switch, the reset voltage is Vref, and the potential of the gate terminal is Vini+(Vref−Vdata); the potential of the source terminal is Vini−Vth+δV, and the potential difference between the gate terminal and the source terminal is Vref−Vdata+Vth−δV, δV=(Vref−Vdata)*C2/(C1+C2), C1 is a capacitance value of the first capacitor, C2 is the capacitance of the first capacitor, so that a driving current is independent of the threshold voltage.

12. The pixel driving method according to claim 11, wherein the pixel driving circuit further comprises a negative voltage-signal terminal, the light-emitting diode comprises a positive terminal and a negative terminal, the fifth switch is connected between the source terminal and the positive terminal, and the negative terminal is connected with the negative voltage-signal terminal;

in the lighting phase, the first control signal terminal, the second control signal terminal, and the fourth control signal terminal are loaded with a high-level signal, the third control-signal terminal is loaded with a low-level signal, so that the first switch, the third switch and the fifth switch are turned on, and the second switch and the fourth switch are turned off, the charge-voltage terminal is loaded with the reset voltage via the first switch, so that the potential of the source terminal is unchanged, and the third switch, the driving transistor, and the fifth switch are turned on, so that the driving-voltage-signal terminal are conducted with the negative voltage-signal terminal, for driving the light-emitting diode light by the driving current.

* * * * *